US006180307B1

(12) United States Patent
Kmiecik-Lawrynowicz

(10) Patent No.: US 6,180,307 B1
(45) Date of Patent: Jan. 30, 2001

(54) LAYERED POLYMER PARTICLES, TONER FORMED THEREFROM AND METHODS FOR FORMING THE SAME

(75) Inventor: Grazyna E. Kmiecik-Lawrynowicz, Fairport, NY (US)

(73) Assignee: Xerox Corporation, Stamford, CT (US)

( * ) Notice: Under 35 U.S.C. 154(b), the term of this patent shall be extended for 0 days.

(21) Appl. No.: 09/523,223

(22) Filed: Mar. 10, 2000

Related U.S. Application Data

(63) Continuation-in-part of application No. 09/447,827, filed on Nov. 23, 1999.

(51) Int. Cl.[7] ..... G03G 9/093

(52) U.S. Cl. ..... 430/109; 137/138

(58) Field of Search ..... 430/109, 137

(56) References Cited

U.S. PATENT DOCUMENTS

| | | | | |
|---|---|---|---|---|
| 4,717,750 | | 1/1988 | Makati et al. | 524/458 |
| 5,079,125 | * | 1/1992 | Anno et al. | 430/109 |
| 5,153,093 | * | 10/1992 | Sacripante et al. | 430/137 |
| 5,496,676 | | 3/1996 | Croucher et al. | 430/137 |
| 5,604,076 | | 2/1997 | Patel et al. | 430/137 |
| 5,853,943 | | 12/1998 | Cheng et al. | 430/137 |
| 5,928,830 | | 7/1999 | Cheng et al. | 430/137 |

* cited by examiner

*Primary Examiner*—Roland Martin
(74) *Attorney, Agent, or Firm*—Oliff & Berridge, PLC

(57) ABSTRACT

A layered particle for use in forming toner may be formed by forming a core region; polymerizing in the presence of the core region at least one monomer feed to form at least one intermediate layer on the core region; and polymerizing in the presence of the core region with at least one intermediate layer thereon a final monomer feed. In the process, each monomer feed is different from the previous monomer feed so as to form different polymer layers.

27 Claims, 1 Drawing Sheet

LAYERED POLYMER PARTICLES, TONER FORMED THEREFROM AND METHODS FOR FORMING THE SAME

This is a Continuation-In-Part of application Ser. No. 09/447,827 pending filed Nov. 23, 1999. The entire disclosure of the prior application is hereby incorporated by reference herein in its entirety.

BACKGROUND OF THE INVENTION

1. Field of Invention

The invention relates to polymer particles, particularly latex polymer particles, that may be used to form toner. The resulting toners can be selected for known electrophotographic imaging and printing processes, including digital color processes, and are especially useful for imaging processes, specifically xerographic processes, which usually require high toner transfer efficiency, such as those having a compact machine design without a cleaner or those that are designed to provide high quality colored images with excellent image resolution and signal-to-noise ratio, and image uniformity, and for imaging systems wherein excellent glossy images are generated.

2. Description of Related Art

Numerous processes are known for the preparation of toners. For example, in conventional processes, a resin is melt kneaded or extruded with a colorant, particularly a pigment, and the product thereof is micronized and pulverized to provide toner particles. The toner particles formed by this process generally have an average volume particle diameter of from about 7 microns to about 20 microns and a broad geometric size distribution of from about 1.4 to about 1.7. As a result, it is usually necessary to subject the aforementioned toner particles to a classification procedure such that a geometric size distribution of from about 1.2 to about 1.4 is attained.

There are also several so-called chemical processes for making toner, among them is the aggregation/coalescence process for making toner particles. In this process, narrow particle size distribution can be achieved without classification. In this process, the resin is prepared as a water based dispersion of sub-micron sized polymeric particles (polymeric latex), which are then aggregated with pigment particles of sub-micron size to the desired toner size and are then coalesced to produce pigmented toner particles.

U.S. Pat. No. 5,853,943, which is herein incorporated in its entirety by reference, is directed to a process for preparing a latex polymer by emulsion polymerization. In this process, the latex polymer is formed by first forming a seed polymer. To form toner from the latex polymer, U.S. Pat. No. 5,853,943 discloses blending the latex with a colorant dispersion; heating the resulting mixture at a temperature below or equal to the Tg of the polymer in the latex to form toner sized aggregates; and heating the aggregates at a temperature at or above the Tg of the polymer to coalesce or fuse the components of the aggregates.

A wide variety of polymer types are used in forming the polymer particles of toner. The polymers include both homopolymeric and copolymeric compositions, such as styrene-butadiene-acrylic acid copolymers, styrene-butyl acrylate-acrylic acid copolymers and acrylic homopolymers.

By selecting various homopolymers and copolymers, toners can be generated that possess specific chemical, mechanical and/or triboelectrical properties. In particular, toners with a low minimum fixing temperature (MFT) are desired to, for example, reduce the energy requirements of the printers and copiers, and to further extend the lifetime of the fuser rolls. However, reducing the MFT of the toner may cause other properties of the toner to be diminished.

For example, as described in U.S. Pat. No. 5,928,830, in pictorial or process color applications, the gloss provided by the toner resin is important to the attainment of high image quality. Unfortunately, a latex that has the desired fix properties may not yield acceptable gloss properties. In particular, if a latex resin has a low molecular weight, that is, for example, a weight average molecular weight (Mw) of about 5,000 to about 30,000, as determined by Gel Permeation Chromatography (GPC), on some fusing devices, the latex resin may result in a developed toner image with an excellent gloss, of, for example, greater than 50 gloss units, such as 70–90, for high quality color applications. However, the toner may have poor fix, that is the MFT may be higher than about 190° C. to about 220° C. for the resulting toner. In contrast, if a latex has a high molecular weight, such as an Mw of about 35,000 to about 80,000, then the latex could result in poor gloss and excellent fix on the same fusing devices.

In addition, as described in U.S. Pat. No. 5,604,076, for certain xerographic properties, such as low minimum fixing temperature, non-vinyl offset characteristics and high gloss properties, polyester resins may be advantageous in comparison to styrene based resins. In contrast, styrene based tone resins may be advantages in comparison to polyester resin for certain properties such as low relative humidity sensitivity, high blocking temperatures and lower unit manufacturing cost.

U.S. Pat. No. 5,496,676, which is herein incorporated in its entirety by reference, suggests blending various latexes to optimize various toner properties. However, it is often difficult to blend various latexes based on differences between them that provide for limited compatibility. In particular, the latexes may be composed of monomers of different classes and/or species. In addition, the different latexes may have different particle surface properties, glass transition temperature and molecular weight. This in turn may cause the resin to phase separate when heated together, providing for domains that are rich in each resin, and thus form separately aggregated particles.

In addition, it is known in the art to copolymerize various monomers together. However, this is not always satisfactory. In particular, toner gloss and fix are predominantly affected by the molecular weight of the latex in contrasting ways. Therefore, the mere copolymerization of various monomers may not allow for the adjustment of the molecular weight, which is suitable for both toner fix and gloss applications.

U.S. Pat. No. 5,928,830, which is herein incorporated in its entirety by reference, is directed to a process for forming latex particles for use in toner in which a core polymer is encapsulated by a shell polymer. By using a core-shell latex, one can select the optimum properties for each of the core and shell resins, which otherwise may not readily be obtainable by a single latex. In embodiments of the invention described therein, the core polymer has a glass transition temperature (Tg) of about 20° C. to about 50° C. and a weight average molecular weight (Mw) of about 5,000 to about 30,000 and the shell polymer has a Tg of about 50° C. to about 70° C. and a Mw of 30,000 or higher.

U.S. Pat. No. 5,604,076, which is herein incorporated in its entirety by reference, is directed to a process for forming toner in which the latex particles comprise a polyester core encapsulated within a styrene based resin shell. In the core-shell latex, the surface characteristics of the toner are directed by the encapsulant component, such as polystyrene-acrylic acid. These surface characteristics include blocking temperature, triboelectric characteristics and RH sensitivity provided by the acid residual. In addition, the polyester core provides for low MFT, high gloss properties and excellent nonvinyl offset performance.

U.S. Pat. No. 4,717,750, which is herein incorporated in its entirety by reference, is directed to a process for preparing a structural reinforced latex particle having improved tensile and elongation properties by emulsion polymerization comprising a three-stage monomer addition. In the process, the second monomer feed forms a polymer having a higher Tg than the first and third monomer feeds.

SUMMARY OF THE INVENTION

Some of the new applications of toner, particularly emulsion aggregation toner for high speed printing devices, require lower melting toner resins. Improvement of fusing by changing the ratio of high and low Tg components has its limitations. In particular, other properties of the toner may be diminished.

The present invention is directed to layered polymeric particles that can be used in making toner. The layered particles of the present invention may provide for toner with a relatively low MFT without having as significant a negative impact on other properties of the toner.

The layered particle of the present invention comprises a core, at least one intermediate polymer layer, and an outer polymer layer. However, it is desired to have several layers of alternating properties to form very thin layer of polymer, which enables interpenetration of polymer chains from one layer to the other providing polymer reinforcement. In the layered particle, the polymer forming each polymer layer is different from the polymer forming each adjacent polymer layer. The differences can be related to the type of polymer, the polymer composition, as well as polymer properties such as Mw and Tg. In embodiments of the invention, the outer polymer layer has a higher Tg than the polymer layer adjacent thereto.

In embodiments of the invention, the core comprises a polymer. In other embodiments of the invention, the core comprises a on-polymeric material, such as an organic or inorganic particle.

The present invention is also directed to a method for making such a layered particle. The method comprises providing a core region; polymerizing in the presence of the core region at least one monomer feed to form at least one intermediate layer on the core region; and polymerizing in the presence of the core region with at least one intermediate layer thereon a final monomer feed to form the layered particle. In the process, the polymer formed from each monomer feed is different from the polymer formed by the previous monomer feed. In addition, in embodiments of the invention, the polymer formed by the final monomer feed has a higher Tg than the polymer formed by the previous monomer feed.

In addition, the present invention is directed to toner comprising aggregates of colorant and layered polymer particles. The layered particles comprise a core region, at least one intermediate polymer layer, and an outer polymer layer. In the layered particle, each polymer layer is different from the polymer forming each adjacent polymer layer.

The present invention is also directed to a process for forming toner. The method of the present invention comprises providing a core region; polymerizing in the presence of the core region at least one monomer feed to form at least one intermediate layer on the core region; polymerizing in the presence of the core region with at least one intermediate layer thereon a final monomer feed to form a layered particle; and mixing the layered particle with colorant to form a toner. In the process, the polymer formed from each monomer feed is different from the polymer formed from the previous monomer feed.

BRIEF DESCRIPTION OF THE DRAWING

In FIG. 1, the black layers represent hard polymer layers and the white layers represent soft polymer layers.

DETAILED DESCRIPTION OF PREFERRED EMBODIMENTS

Figure 1:
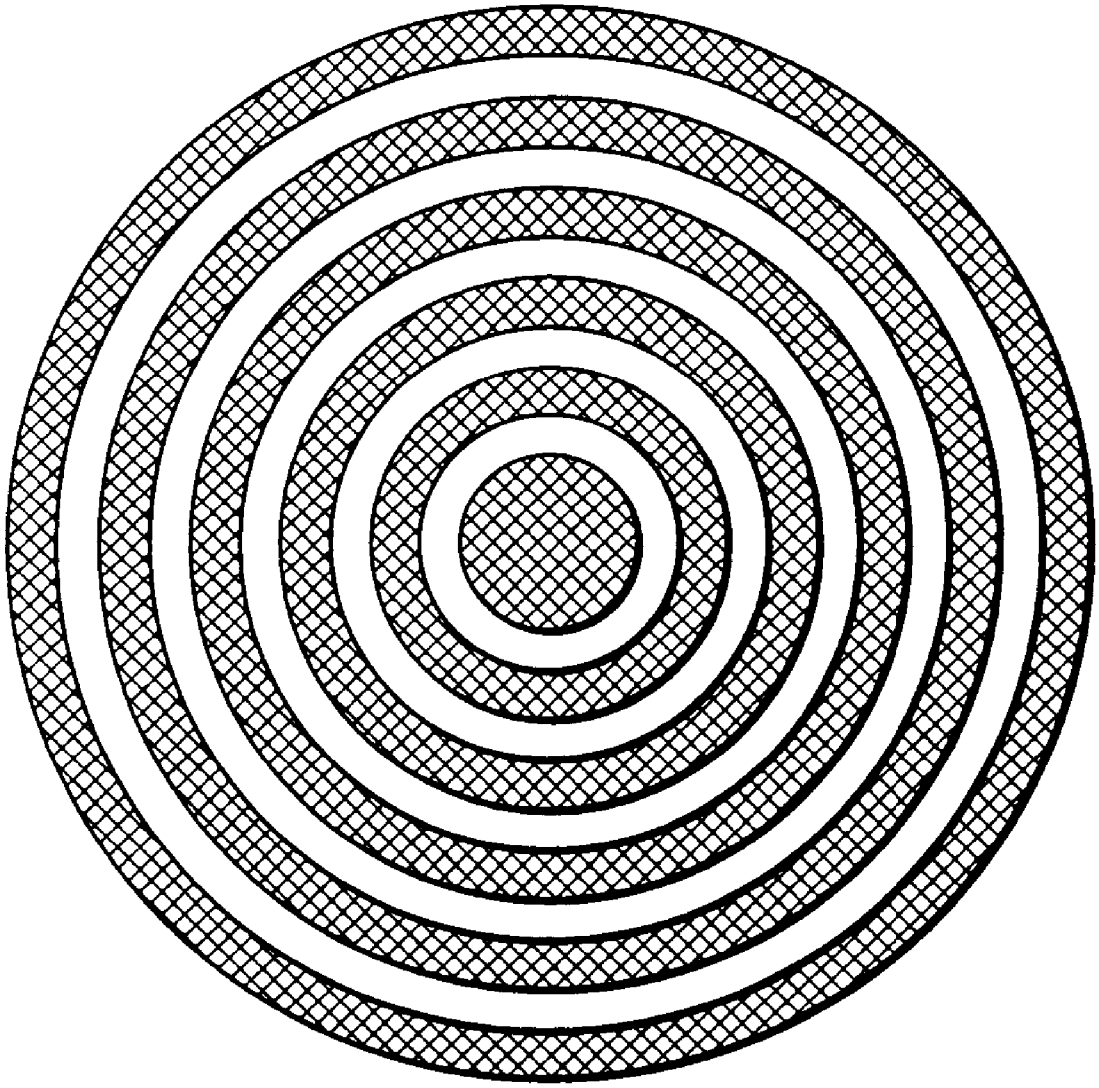
FIG. 1 demonstrates an embodiment of the invention.

A process for producing layered particles comprises feeding a specific monomer, polymerizing this monomer to form a layer and then feeding monomer and polymerizing for the next layer. This procedure can be repeated several times until the desired number of layers and desired particle sizes are accomplished.

The layered particles of the present invention may be formed by emulsion polymerization. In particular, a multi-stage emulsion polymerization process may be used. By varying the polymer layers, and preparing an onion-like structured latex particle, polymeric resins with unique properties can be produced. In particular, better mechanical properties and therefore better crease can be achieved. In addition, layered particles show efficient internal plasticization and internal reinforcement. By using these materials, lower melting toner resins can be prepared without sacrificing the mechanical properties.

The layered particles of the present invention may be used in both emulsion aggregation toner as well as conventional toner. For use in emulsion aggregation processes, in particular, the particles can, for example, have a particle size of from about 0.05 micron to about 1 micron in volume average diameter as measured by the Brookhaven disc centrifuge or other nanosize particle analyzer. However, larger or smaller particles may be used in embodiments of the invention.

Better mechanical properties are achieved by using thinner polymer layers. In particular, in a preferred embodiment of the invention, one or more of the layers, and preferably all of the layers on the core, have a thickness of less than 50 nm, preferably less than 20 nm, and even more preferably less than 10 nm. Extending the number of layers makes them thinner for the same size of latex particles. Using thinner layers may allow the properties of each layer to penetrate into the adjacent layers to reinforce the properties thereof. Thus, in order to obtain the desired particle size with thinner layers, in a preferred embodiment of the invention, the layered particle has more than one intermediate layer. In particular, in a preferred embodiment, the layered particle has at least two intermediate layers, more preferably at least three intermediate layers, and even more preferably at least four or more intermediate layers. However, the number of layers must be balanced with the additional time and effort necessary to prepare each layer of the multilayered structure.

In embodiments of the invention, a layer having a higher Tg, which may be referred to as the hard layer, may be alternated with a layer having a lower Tg, which may be referred to as the soft layer. The soft layer may provide for a lower MFT and higher gloss. In addition, the hard layer may provide for better mechanical properties, and better hot offset properties. In an embodiment of the invention, as demonstrated in FIG. 1, the outer layer is made of the harder polymer so as to provide for better blocking characteristics and better flow. By alternating these properties of the layers, the hard layers may reinforce the mechanical properties of the soft layers to provide for overall better mechanical properties, and the softer layers may act as a plasticizer for the harder layers.

Another factor that has an effect on the toner fusing properties, such as MFT, gloss and hot offset, is the molecular weight of the polymer. Therefore, improvement in the material performance can also be achieved by alternating between polymer layers of a higher and a lower molecular weight. Thus, in embodiments of the invention, a layer having a higher Mw, or alternatively a higher number average molecular weight (Mn), may be alternated with a layer having a lower Mw, or alternatively a lower Mn.

In an embodiment of the invention, the alternating layers may be formed by switching between two different monomer feeds such that every other layer is formed of the same polymer. However, each layer may also be formed of a different polymer. In particular, the core is often formed of a different polymer than the other layers and may also be formed of a non-polymeric material including organic and inorganic materials or of mixtures of polymeric materials with non-polymeric materials.

In a particular embodiment of the invention, a crosslinked polymer is used to form the core by seed polymerization. A series of soft and hard layers are then formed on the core. The soft layers, which generally have a Tg of less than about 50° C., preferably from about 20° C. to about 50° C., can be formed of, for example, polybutyl acrylate and/or β-CEA or copolymers thereof. The hard layers, which generally have a Tg of greater than about 50° C., preferably from about 50° C. to about 70° C., can be formed of, for example, styrene or copolymers thereof. In this embodiment, the final layer is generally a hard layer to provide the beneficial effects of a hard layer on the surface of the particle. Also the outer layer (shell) can be formed of a different polymer than any of the other layers, to enable desired surface properties of polymeric latex.

One or more monomers may be used to form each layer of the layered particle. Any suitable monomers may be used. Monomers particularly useful include, but are not limited to, acrylic and methacrylic esters, styrene, vinyl esters of aliphatic acids, ethylenically unsaturated carboxylic acids and known crosslinking agents. Suitable ethylenically unsaturated carboxylic acids can be acrylic acid, methacrylic acid, itaconic acid, maleic acid, fumaric acid, 2-carboxyethyl acrylate (β-CEA), and the like.

In embodiments of the invention, the layered particle is formed by a multi-stage emulsion polymerization process. In particular, the layered particle may be formed by preparing an emulsion of monomers in water; mixing a polymerization initiator with the monomer emulsion to initiate polymerization, thus forming the core region; adding additional monomer to the composition and polymerizing the additional monomer to form an intermediate layer; optionally repeating the preceding step one or more times to form additional intermediate layer(s); and adding additional monomer to the composition and polymerizing the additional monomer to form the outer layer of the layered particle.

In the process, the monomers for use in the first monomer feed are generally mixed with water to form an emulsion. The emulsification is generally accomplished at a temperature of about 5° C. to about 40° C. However, the emulsion may also be formed at higher temperatures in particular. To form an emulsion, the mixture is generally agitated at, for example, at least 100 rpm, and preferably at least 400 rpm, for sufficient time to form an emulsion. The time required to form an emulsion is generally less if the mixture is agitated at a higher speed. In addition, the agitation speed may even be less than 100 rpm if the agitation is continued for a sufficient amount of time.

In addition, a chain transfer agent is preferably added to the monomer emulsion to control the molecular weight properties of the polymer to be formed. Chain transfer agents that may be used in the present invention include, but are not limited to, dodecanethiol, butanethiol, isooctyl-3-mercaptopropionate (IOMP), 2-methyl-5-t-butylthiophenol, carbon tetrachloride, carbon tetrabromide, and the like. Chain transfer agents may be used in any effective amount, such as from about 0.1 to about 10 percent by weight of the monomer in the monomer emulsion.

In addition, surfactants may be added to the monomer emulsion to stabilize the emulsion. The surfactants that may be added include ionic and/or nonionic surfactants.

Nonionic surfactants that may be used include, but are not limited to, dialkylphenoxypoly(ethyleneoxy) ethanol, available from Rhone-Poulenac as IGEPAL CA-210.TM., IGEPAL CA-520.TM., IGEPAL CA-720.TM., IGEPAL CO-890.TM., IGEPAL CO-720.TM., IGEPAL CO-290.TM., IGEPAL CA-210.TM., ANTAROX 890.TM. and ANTAROX 897.TM. An effective concentration of the nonionic surfactant may be, for example, from about 0.01 to about 10 percent by weight, and preferably from about 0.1 to about 5 percent by weight of the monomers used to prepare the polymer layer.

As an ionic surfactant, either an anionic or a cationic surfactant may be used. Examples of anionic surfactants include, but are not limited to, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R.TM., NEOGEN SC.TM. obtained from Kao, and the like. An effective concentration of anionic surfactant may be, for example, from about 0.01 to about 10 percent by weight, and preferably from about 0.1 to about 5 percent by weight of monomers used to prepare the polymer layer.

Examples of the cationic surfactants include, but are not limited to, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL.TM. and ALKAQUAT.TM. available from Alkaril Chemical Company, SANIZOL.TM. (alkyl benzalkonium chloride), available from Kao Chemicals, and the like, and mixtures thereof. This surfactant may be utilized in various effective amounts, such as for example from about 0.1 percent to about 5 percent by weight of water.

Suitable initiators include, but are not limited to, ammonium persulfate, potassium persulfate, sodium persulfate, ammonium persulfite, potassium persulfite, sodium persulfite, ammonium bisulfate, sodium bisulfate, 1,1'-azobis(1-methylbutyronitrile-3-sodium sulfonate), 4,4'-azobis(4-cyanovaleric acid), hydrogen peroxide, t-butyl hydroperoxide, cumene hydroperoxide, para-methane hydroperoxide, benzoyl peroxide, tert-butyl peroxide, cumyl peroxide, 2,2'-azobisisobutyronitrile, 2,2'-azobis(2-methylbutyronitrile), 2,2'-azobis(2-amidinopropane) dihydrochloride, 2,2'-azobisisobutyl amide dihydrate, 2,2'-azobis[2-(2-imidazolin-2-yl)propane]dihydrochloride, and 2,2'-azobis[2-(5-methyl-2-imidazolin-2-yl)propane] dihydrochloride. Preferably, the initiator is a persulfate initiator such as ammonium persulfate, potassium persulfate, sodium persulfate and the like. The initiator is generally added as part of an initiator solution in water. The amount of initiator used to form the polymer layer is generally from about 0.1 to about 10 percent by weight of the monomer to be polymerized.

The monomer emulsion may be used to form the core of the latex polymer. The emulsion polymerization is generally conducted at a temperature of from about 35° C. to about 125° C., preferably from 60° C. to 90° C. The portion of the monomer used to form the core polymer is generally from about 0.5 to about 50 percent by weight of the total amount of monomer used to prepare the latex polymer. Preferably, the amount of monomer used to form the core polymer is from about 3 to 25 percent by weight of the total amount of monomer used to form the latex polymer.

Additional monomer is then sequentially added to the core polymer to form each layer of the particles. The emulsion polymerization at each stage is generally conducted at a temperature of from about 35° C. to about 125° C., preferably from 60° C. to 90° C. The additional monomers are generally fed to the composition at an effective time period of, for example, 0.3 to 6 hours, preferably 0.5 to 4 hours. The additional monomers for the various layers may be in the form of a monomer emulsion. In addition, additional initiator, chain transfer agent and/or surfactant may or may not be added to the monomer feeds after the core polymer is formed.

Illustrative examples of polymer layers that may be formed by the process of the present invention include, but are not limited to, known polymers such as poly(styrene-butadiene), poly(methyl methacrylate-butadiene), poly (ethyl methacrylate-butadiene), poly(propyl methacrylate-butadiene), poly(butyl methacrylate-butadiene), poly (methyl acrylate-butadiene), poly(ethyl acrylate-butadiene), poly(ethylhexylacrylate), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly (styrene-beta-carboxyethylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and the like.

Difference between the adjacent polymer layers may be achieved by varying the monomers in the monomer feeds. In particular, the type of monomer and/or the amount of each monomer present in the monomer feed may be varied. In addition, difference may be achieved by varying other factors in the monomer feed, such as the presence of chain transfer agents to vary the molecular weight of the polymer formed thereby.

In embodiments, the present invention is directed to processes for the preparation of toner from the layered particles of the present invention. In particular, the layered particles of the present invention may be used to form toner by conventional techniques. For example, the layered particles may be melt kneaded or extruded with a colorant and the product thereof may be micronized and pulverized to provide toner particles.

Alternatively, the layered particles of the present invention may be utilized in forming toner by emulsion aggregation techniques. In particular, the process may comprise blending a colorant, preferably a colorant dispersion, more preferably containing a pigment, such as carbon black, phthalocyanine, quinacridone or RHODAMINE B.TM. type, with a latex polymer prepared as illustrated herein and optionally with a flocculate and/or charge additives; heating the resulting flocculate mixture at a temperature below the Tg of the latex polymer, preferably from about 25° C. to about 1° C. below the Tg of the latex polymer, for an effective length of time of, for example, 0.5 hour to about 2 hours, to form toner sized aggregates; subsequently heating the aggregate suspension at a temperature at or above the Tg of the latex polymer, for example from about 60° C. to about 120° C., to effect coalescence or fusion, thereby providing toner particles; and isolating the toner product, such as by filtration, thereafter optionally washing and drying the toner particles, such as in an oven, fluid bed dryer, freeze dryer, or spray dryer.

The latex polymer is generally present in the toner compositions in various effective amounts, such as from about 75 weight percent to about 98 weight percent of the toner. However, other effective amounts of latex polymer may be selected in embodiments.

Colorants include pigments, dyes, and mixtures of pigments with dyes, and the like. The colorant is generally present in the toner in an effective amount of, for example, from about 1 to about 15 percent by weight of toner, and preferably in an amount of from about 3 to about 10 percent by weight of the toner.

Illustrative examples of colorants, such as pigments, that may be used in the processes of the present invention include, but are not limited to, carbon black, such as REGAL 330.RTM.; magnetites, such as Mobay magnetites MO8029.TM., MO8060.TM.; Columbian magnetites; MAPICO BLACKS.TM. and surface treated magnetites; Pfizer magnetites CB4799.TM., CB5300.TM., CB5600.TM., MCX6369.TM.; Bayer magnetites, BAYFERROX 8600.TM., 8610.TM.; Northern Pigments magnetites, NP-604.TM., NP-608.TM.; Magnox magnetites TMB-100.TM., or TMB-104.TM.; and the like. Colored pigments or dyes, including cyan, magenta, yellow, red, green, brown, blue and/or mixtures thereof, may also be used. Generally, cyan, magenta, or yellow pigments or dyes, or mixtures thereof, are used. The pigment is generally used as a water based pigment dispersion.

Specific examples of pigments include, but are not limited to, SUNSPERSE 6000 TM, FLEXIVERSE TM and AQUATONE TM water based pigment dispersions from SUN Chemicals, HELIOGEN BLUE L6900.TM., D6840.TM., D7080.TM., D7020.TM., PYLAM OIL BLUE.TM., PYLAM OIL YELLOW.TM., PIGMENT BLUE 1.TM. available from Paul Uhlich & Company, Inc., PIGMENT VIOLET 1.TM., PIGMENT RED 48.TM., LEMON CHROME YELLOW DCC 1026.TM., E.D. TOLUIDINE RED.TM. and BON RED C.TM. available from Dominion Color Corporation, Ltd., Toronto, Ontario, NOVAPERM YELLOW FGL.TM., HOSTAPERM PINK E.TM. from Hoechst, and CINQUASIA MAGENTA.TM. available from E.I. DuPont de Nemours & Company, and the like. Examples of magentas include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK.TM., and cyan components may also be selected as pigments with the process of the present invention.

Flocculates may be used in effective amounts of, for example, from about 0.01 percent to about 10 percent by weight of the toner. Flocculants that may be used include, but are not limited to, polyaluminum chloride (PAC), dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL.TM. and ALKAQUAT.TM. available from Alkaril Chemical Company, SANIZOL.TM. (benzalkonium chloride), available from Kao Chemicals, and the like.

Charge additives may also be used in suitable effective amounts of, for example, from 0.1 to 5 weight percent by weight of the toner. Suitable charge additives include, but are not limited to, alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

The following example illustrates a specific embodiment of the present invention. One skilled in the art will recognize that the appropriate reagents, component ratio/concentrations may be adjusted as necessary to achieve specific product characteristics. All parts and percentages are by weight unless otherwise indicated.

EXAMPLE

I. Preparation of multilayered polymeric particle by emulsion polymerization.

A seven layered carboxylated latex comprised of styrene/n-butyl acrylate/β-CEA copolymer of 82:18:3 composition using 1.5% of ammonium persulfate initiator is synthesized by in-situ seeded, stepwise semi-continuous emulsion polymerization process using Dowfax 2A1 (sodium tetrapropyl diphenyloxide disulfonate, Dow Chemical) as an anionic surfactant.

A solution of Dowfax 2A1 (47% aq.) surfactant (5.4 parts in 770 parts of water) is prepared. 518 parts of this solution is charged into a 2L jacketed glass flask with a stirrer set at 250 rpm, and it is dearated for 30 min with nitrogen, while the temperature is raised to 80° C. A monomer emulsion for seed formation is prepared by mixing 8.86 parts of styrene with 0.3 parts of dodecanethiol (DDT) and is charged to the reactor. An initiator solution prepared from 8.1 parts of ammonium persulfate in 40 parts of deionized water is added over 20 minutes (except for 5.5 parts of this solution). Stirring continues for an additional 22 minutes to allow seed particle formation.

A first monomer feed consisting of butyl acrylate (BA) emulsion (32.4 parts of BA+42.9 parts of Dowfax solution+2.12 parts of DDT) is charged into the reactor over 20 minutes, followed by a 46 minute addition of a second feed, a styrene emulsion (144.7 parts of styrene+42.9 parts of Dowfax solution+2.12 parts of DDT). After this, another layer of the butyl acrylate emulsion is added over 19 minutes, followed by another feed of the styrene emulsion, which is added over 51 minutes. Following this, a last layer of the butyl acrylate emulsion is added over 18 minutes followed by the last feed consisting of an emulsion of styrene and β-CEA (144.7 parts styrene+16.2 parts of β-CEA+42.9 parts of Dowfax+2.12 parts of DDT) added over 44 minutes. The reactor content is mixed and 5.5 parts of initiator solution is added. Reaction is continued for additional 2 hours at 80° C., and then the reactor content is cooled down to room temperature. The process results in separated seven layered latex particles having a size of 400 nm with unimodal distribution and having a Mw=33 K, a Mn=11.8 K, and a Tg=52° C.

II. Aggregation/Coalescence of multilayered polymeric particles with pigment to form toner particles.

260 grams of the above "as is" latex is simultaneously added, with a pigment solution containing 7.6 grams of cyan pigment 15.3, commercially available from Sun Chemical as a BHD 6000 dispersion in water (~53% solids), 2.3 grams of Sanizol B, and 220 grams of deionized water, to 400 grams of deionized water while being polytroned at 10000 RPM. The dispersion is then transferred into a 2L jacketed kettle and the temperature is raised to 46° C. and held there for 1.5 hours to perform the aggregation. The particle size measured is 6.7 mm with a GSD of 1.24. 25 ml of anionic surfactant Biosoft D40 (20% aq.) is then added to the aggregates. The coalescence step is performed by raising the temperature to 93° C. and holding it there for a period of 2.5 hours. The particle size measured upon completion was 6.9 mm with a GSD of 1.25. Coalesced particles are then washed at pH=8.5 to remove residual surfactants and rinsed with water to remove KOH. After drying on a freeze-dryer, free flowing cyan toner particles are obtained.

III. Fusing Evaluation of toner particles prepared from multilayered latex particles.

The above cyan toner particles are than evaluated by forming images in a Mita copier, and fusing the images using a soft fuser, to determine the image gloss and minimum fusing temperature. The fusing properties of this toner are excellent compared with toner particles with similar molecular properties. This toner gives crease 60 fix of 148° C. on ILX paper, which is much lower than the value for corresponding toner particles prepared from homogenous latex, which had a crease of 60 at 168° C. The blocking temperature is also 10 degrees higher indicating a harder shell in the layered latex, preventing premature toner blockage. COT and HOT temperatures are very comparable. The $G_{50}$ gloss temperature is 8 degrees lower for the layered toner than for the reference toner, meaning that higher gloss can be achieved at the lower temperature of the fuser.

What is claimed is:

1. A method for forming toner, comprising:

(a) providing a core region;

(b) polymerizing in the presence of said core region at least one monomer feed to form at least one intermediate polymer layer on said core region;

(c) polymerizing in the presence of the core region with said at least one intermediate layer thereon an additional monomer feed to form a final polymer layer, thus forming a layered particle; and (d) mixing the layered particle with colorant to form toner, wherein the polymer of each said polymer layer is different from the polymer of each adjacent polymer layer and, where the core region comprises a polymer, the polymer of the core region is different from the polymer of the adjacent polymer layer.

2. A method according to claim 1, wherein said layered particle is formed by multistage emulsion polymerization.

3. A method according to claim 1, wherein said layered particle is formed by multistage emulsion polymerization with seed added as the core region.

4. A method according to claim 3, where the seed added as the core region comprises at least one of a polymer and an organic or inorganic particle.

5. A method according to claim 1, wherein (d) comprises aggregating said colorant with the layered particles to form aggregates and coalescing the aggregates to form toner.

6. A method according to claim 1, wherein (d) comprises melt kneading or extruding the colorant with the layered particles and pulverizing the resulting product to form toner particles.

7. A method according to claim 1, wherein (b) comprises sequentially polymerizing at least two monomer feeds to form at least two intermediate polymer layers.

8. A method according to claim 1, wherein (b) comprises sequentially polymerizing at least three monomer feeds to form at least three intermediate polymer layers.

9. A method according to claim 1, wherein said at least one intermediate polymer layer and said final polymer layer alternate between a layer that has a higher Tg than each adjacent polymer layer and a layer that has a lower Tg than each adjacent polymer layer, with the final polymer layer having a higher Tg than the adjacent polymer layer.

10. A method according to claim 1, wherein said at least one intermediate polymer layer and said final polymer layer alternate between a layer that has a higher Mw than each adjacent polymer layer and a layer that has a lower Mw than each adjacent polymer layer.

11. A method for forming a layered particle, comprising:

(a) providing a core region;

(b) polymerizing in the presence of said core region at least one monomer feed to form at least one intermediate polymer layer on said core region; and (c) polymerizing in the presence of the core region with said at least one intermediate layer thereon a final monomer feed to form a final polymer layer, wherein the polymer of each said polymer layer is different from the polymer of each adjacent polymer layer and, where the core region comprises a polymer, the polymer of the core region is different from the polymer of the adjacent polymer layer and the polymer of the final polymer layer has a higher glass transition temperature (Tg) than the polymer of the adjacent polymer layer.

12. A method according to claim 11, wherein (b) comprises sequentially polymerizing at least two monomer feeds to form at least two intermediate polymer layers and wherein said at least two intermediate polymer layers and said final polymer layer alternate between a layer that has a higher Tg than each adjacent polymer layer and a layer that has a lower Tg than each adjacent polymer layer.

13. A layered particle formed by the process of claim 12.

14. A layered particle comprising a core, at least two intermediate polymer layers encapsulating said core, and an outer polymer layer covering said at least two intermediate layers, wherein each of said at least two intermediate polymer layers and said outer polymer layer alternate between a layer that has a higher glass transition temperature (Tg) than each adjacent polymer layer and a layer that has a lower Tg than each adjacent polymer layer, with the outer polymer layer having a higher Tg than the adjacent polymer layer.

15. A toner particle comprising colorant and a layered particle according to claim 14.

16. A toner particle according to claim 15, wherein said colorant is fused to said layered particle.

17. A layered particle according to claim 14, wherein each of said at least two intermediate polymer layers and said outer polymer layer alternate between a layer that has a higher Mw than each adjacent polymer layer and a layer that has a lower Mw than each adjacent polymer layer.

18. A method according to claim 1, wherein at least one of said intermediate and final polymer layers have a thickness of less than 50 nm.

19. A method according to claim 18, wherein each of said intermediate and final polymer layers have a thickness of less than 50 nm.

20. A method according to claim 11, wherein said core region comprises a polymer having a higher Tg than the adjacent polymer layer.

21. A layered particle according to claim 14, wherein each of said at least two intermediate polymer layers and said outer polymer layer alternate between a layer that has a higher Mn than each adjacent polymer layer and a layer that has a lower Mn than each adjacent polymer layer.

22. A layered particle according to claim 14, wherein at least one of the intermediate and outer polymer layers have a thickness of less than 50 nm.

23. A layered particle according to claim 22, wherein each of the intermediate and outer polymer layers have a thickness of less than 50 nm.

24. A layered particle according to claim 22, wherein at least one of the intermediate and outer polymer layers have a thickness of less than 20 nm.

25. A layered particle according to claim 22, wherein at least one of the intermediate and outer polymer layers have a thickness of less than 10 nm.

26. A layered particle according to claim 14, said layered particle comprising at least three intermediate polymer layers.

27. A method according to claim 1, wherein the final polymer layer has a higher Tg than the adjacent polymer layer.

* * * * *